US011209130B2

(12) United States Patent
Rosenbauer et al.

(10) Patent No.: US 11,209,130 B2
(45) Date of Patent: Dec. 28, 2021

(54) METHOD FOR PRODUCING A TUBE LAMP AND CORRESPONDING TUBE LAMP

(71) Applicant: LEDVANCE GmbH, Garching bei Munchen (DE)

(72) Inventors: Georg Rosenbauer, Wassertrüdingen (DE); Bernhard Rieder, Regensburg (DE); Henrike Streppel, Regensburg (DE); Andreas Hammer, Regensburg (DE); Georg Scheipl, Westendorf (DE); Klaus Eckert, Herbrechtingen (DE)

(73) Assignee: LEDVANCE GMBH, Garching bei München (DE)

( * ) Notice: Subject to any disclaimer, the term of this patent is extended or adjusted under 35 U.S.C. 154(b) by 40 days.

(21) Appl. No.: 16/654,593

(22) Filed: Oct. 16, 2019

(65) Prior Publication Data

US 2020/0116309 A1 Apr. 16, 2020

(30) Foreign Application Priority Data

Oct. 16, 2018 (DE) ..... 102018125645.0

(51) Int. Cl.

| | |
|---|---|
| ***F21K 9/275*** | (2016.01) |
| ***F21V 15/01*** | (2006.01) |
| ***F21V 19/00*** | (2006.01) |
| ***F21K 9/90*** | (2016.01) |
| ***F21K 9/278*** | (2016.01) |
| ***H01K 5/02*** | (2006.01) |
| *F21Y 103/10* | (2016.01) |
| *F21Y 115/10* | (2016.01) |
| *F21K 9/20* | (2016.01) |

(52) U.S. Cl.

CPC ..... *F21K 9/275* (2016.08); *F21K 9/278* (2016.08); *F21K 9/90* (2013.01); *F21V 15/01* (2013.01); *F21V 19/001* (2013.01); *F21V 19/005* (2013.01); *H01K 5/02* (2013.01); *F21K 9/20* (2016.08); *F21Y 2103/10* (2016.08); *F21Y 2115/10* (2016.08)

(58) Field of Classification Search

CPC . F21K 9/275; F21K 9/278; F21K 9/90; F21K 9/20; H01K 5/02; F21V 19/001; F21V 15/01; F21V 19/005; F21Y 2103/10; F21Y 2115/10; B23P 21/00; B23P 15/00

See application file for complete search history.

(56) References Cited

U.S. PATENT DOCUMENTS

| | | | | |
|---|---|---|---|---|
| 10,700,251 | B2 * | 6/2020 | Lang | F21V 23/006 |
| 2010/0102729 | A1 * | 4/2010 | Katzir | F21K 9/278 315/113 |

(Continued)

FOREIGN PATENT DOCUMENTS

| | | | |
|---|---|---|---|
| DE | 102017131063 | A1 | 6/2019 |
| DE | 102018124471 | B3 | 12/2019 |

(Continued)

*Primary Examiner* — Tracie Y Green

(74) *Attorney, Agent, or Firm* — Hayes Soloway PC

(57) ABSTRACT

A method for producing a tube lamp uses at least one leadframe. A leadframe is a flat structure which has two opposing surfaces extending substantially parallel and spaced apart by the sheet thickness. One or more stabilizing sections are applied to the leadframe. The leadframe is fastened with the stabilizing sections in a tubular housing of the tube lamp.

22 Claims, 3 Drawing Sheets

(56) References Cited

U.S. PATENT DOCUMENTS

| | | | | |
|---|---|---|---|---|
| 2011/0260646 | A1* | 10/2011 | Moon | H01L 25/0753 315/294 |
| 2011/0267814 | A1* | 11/2011 | Moon | F21K 9/275 362/235 |
| 2019/0003659 | A1* | 1/2019 | Miyajima | F21K 9/27 |
| 2019/0195439 | A1* | 6/2019 | Rieder | F21K 9/27 |

FOREIGN PATENT DOCUMENTS

| | | | |
|---|---|---|---|
| EP | 3502542 | A1 | 6/2019 |
| WO | 2011064305 | A1 | 6/2011 |

* cited by examiner

METHOD FOR PRODUCING A TUBE LAMP AND CORRESPONDING TUBE LAMP

CROSS-REFERENCE TO RELATED APPLICATIONS AND PRIORITY

This patent application claims priority from DE Patent Application No. 102018125645.0 filed Oct. 16, 2018, which is herein incorporated by reference in its entirety.

TECHNICAL FIELD

The present invention relates to a method for producing a tube lamp, in particular an LED retrofit tube lamp, for example the T5 and T8 models. The invention further relates to a correspondingly produced tube lamp.

PRIOR ART

Fluorescent tube lamps are increasingly being replaced by retrofit tube lamps with semiconductor light elements (for example light-emitting diodes, LEDs). Such retrofit tube lamps usually have a housing in the form of a tubular bulb which is at least partially light-permeable (translucent or transparent), with two end caps at the two ends of the tubular bulb, a light engine which contains a plurality of LEDs, and an electronic driver which supplies the LEDs with electrical energy with the necessary electrical parameters (current, voltage) for operation thereof.

The term "light engine" is usually used for the arrangement of the plurality of LEDs and a holding structure for the LEDs, which contains electrically conductive structures and/or cables by means of which the LEDs can be supplied with electric power by the electric driver.

For the light engine, many retrofit LED tube lamps use a printed circuit board on which the LEDs are fastened, for example soldered. Such printed circuit boards are usually produced by etching of a blank which has a copper coat arranged on an electrically non-conductive substrate. This results in a high consumption of copper and correspondingly high production costs and substantial environmental pollution. The same applies when a carrier material (for example made of plastic) is used with fabric stabilisation (for example glass fibre material impregnated with epoxy resin) of corresponding thickness (for example 1 mm).

The use of leadframes as a substitute for conventional printed circuit boards in retrofit tube lamps is known from European Patent Application EP 18152566.8, the disclosure of which is incorporated completely herein by reference.

Electrically conductive structures which are stamped or cut out of a sheet metal (for example by means of laser cutting or water jet cutting) and function without an electrically insulating substrate (such as a printed circuit board) or electrically insulating, flexible layers (such as wiring boards), are designated here as leadframes. For production of a leadframe the conductive tracks are stamped or cut out of a sheet, wherein transport strips and connection bars for stabilisation of the stamped sheet remain for further processing. The transport strips and connection bars are removed at a later time, for example if the leadframe is sufficiently stabilised by electrical components fastened thereon. A method for producing a leadframe is known for example from German patent application DE 10 2018 124 471.1, the disclosure of which is incorporated completely herein by reference.

Leadframes can be fastened inside the tubular housing of a tube lamp by fastening one or more retaining clips on the leadframe, for example by a positively engaged connection. These retaining clips are then adhered to the inner side of the tubular housing. Such retaining clips are known from the international patent application WO 2011/064305 A1, the disclosure of which is incorporated completely herein by reference.

In the above-mentioned European patent application EP 18152566.8 it is proposed to provide a leadframe with projections (embossings, deep-drawn sections), on which the leadframe is directly adhered with the inner side of the tubular housing.

SUMMARY OF THE INVENTION

Starting from the known prior art, it is an object of the present invention to provide an improved method for producing a tube lamp, in particular an improved fastening of the leadframe inside the tubular housing of a tube lamp, as well as an improved tube lamp.

The object is achieved by a method for producing a tube lamp and by a tube lamp with the features of the independent claims. Advantageous further embodiments are set out in the subordinate claims.

A leadframe is a flat structure which has two opposing surfaces extending substantially parallel and spaced apart by the sheet thickness. The leadframe can be manufactured for example from a cost-effective material, such as for instance steel, or a material with high thermal conductivity, such as for instance copper, or a metal with an optically high grade appearance, such as for instance brass. The sheet thickness is preferably in the range from 0.1 mm to 2 mm, more preferably in the range from 0.2 mm to 0.8 mm. In particular, materials which can be used for printed circuit boards (PCBs) are suitable. Moreover, the leadframe can be coated for example with a Sn, Zn, Au, Ag, Pt, Pd or Ni layer, and/or the surfaces of the leadframes can be partially or completely roughened. The surfaces of the leadframe can also be coated with a good reflecting coating, for example with a white or light colour or lacquer layer (in particular solder resist).

Leadframes for tube lamps have a longitudinal direction, which is the direction in which the extent of the leadframe (length) is significantly greater than in the two directions (width and thickness) perpendicular to the longitudinal direction.

In a method according to the invention for producing a tube lamp, first of all at least one leadframe is provided. The leadframe can be produced by a stamping and/or cutting process from a metal sheet. The individual electrically conductive sections of the leadframe (hereafter also referred to as leadframe element) can be connected to one another by connecting sections (also referred to as connection bars) which are later removed. The leadframe can already be equipped with electronic components, in particular semiconductor light elements such as LEDs and possibly components of an electronic driver which can be soldered on the leadframe.

If in the case of a leadframe equipped with electronic components the connecting sections are removed, a movement of the leadframe for example during the further processing can lead to loading of the connection points between the leadframe and the electronic components (that is to say the solder points) and to a mechanical loading of the electronic components until they break.

In order to reduce this loading, one or more stabilizing sections are applied to the leadframe so that the stabilizing sections connect a plurality of the leadframe elements mechanically to one another. The stabilizing section can be present, for example, in the form of strips, which extend perpendicularly to the longitudinal direction of the leadframe, that is to say at least partially over the width of the leadframe. The stabilizing sections are made from an electrically insulating material.

The mechanical connection between the stabilizing sections and the leadframe can be made by non-positive and/or positive engagement. A non-positive connection can be achieved, for example, by adhesion of the material of the stabilizing sections on the material of the leadframe. For a positively engaged connection the material of the stabilizing sections can extend, for example, through the intermediate spaces between the leadframe elements and along both surfaces of the leadframe. Non-positively engaged and positively engaged connection can also be used simultaneously.

The stabilizing sections are preferably applied to the leadframe at a time when the leadframe elements are still connected to one another by connecting sections or already connected by means of electronic components. For example, in a leadframe blank, in which the leadframe elements are still connected to one another by connecting sections, first of all the electronic components are fastened and then the stabilizing sections are applied, or first of all the stabilizing section are applied and then the electronic components are fastened. Severing of the connecting section takes place preferably only when the electronic components have been fastened and/or the stabilizing sections have been applied.

The use of stabilizing sections on a leadframe is also described in German patent application DE 10 2017 131 063.0, the disclosure of which is incorporated completely herein by reference.

The stabilizing sections can be arranged on a surface of the leadframe or on both surfaces of the leadframe. An application to a surface does not preclude the material of a stabilizing section extending through the intermediate spaces between the leadframe elements to the other surface, as already mentioned above with regard to a positively engaged connection.

For example, at some locations on the leadframe the stabilizing sections can be applied only to one surface (in particular alternately to both surfaces), and at other locations they can also be applied to both surfaces.

Furthermore, a tubular housing of the tube lamp is provided. The housing part can be made for example from a plastic or from glass. The housing is at least translucent, so that the light generated by the semiconductor light elements in the interior of the housing can leave the tube lamp through the housing.

The tubular housing is open on at least one side, so that the leadframe provided with electronic components and stabilizing elements can be introduced into the interior of the housing. The leadframe is then fastened, in particular adhered, in the interior of the housing, that is to say on the inner side using at least some stabilizing sections.

Thus the method according to the invention makes it possible to dispense with additional components such as retaining clips as well as dispensing with additional steps in the processing of the leadframe or the leadframe elements such as the provision of projections.

The stabilizing sections can be made, for example, from a thermoplastic material (in particular from a hotmelt adhesive) and/or from glass. These materials can be moulded well in a liquid or at least viscous state and can be applied and connected to the leadframe at the required locations.

In one embodiment of the method the fastening of the leadframe in the tubular housing by means of the stabilizing sections takes place in that the stabilizing sections (at least the stabilizing sections which are intended to serve for fastening the leadframe in the tubular housing) are heated to a temperature at which the stabilizing sections are molten. In this case "molten" (also "thermoplastic" or "flowable") is understood to mean a state in which the material of the stabilizing sections begins to become liquid or at least viscous, so that the shape of the stabilizing section can be changed. In particular, the stabilizing sections melt to such an extent that they can effect a functionally sufficient adhesive or bonding connection to the tubular housing.

Technomelt AS 5376 or PA6208 (which can be obtained from Henkel AG & Co. KGaA) can be used for example as material for the stabilizing sections. Here the temperature at which the material is molten is approximately 180° C.-200° C.

The heating of the stabilizing sections can take place for example by heating of the tubular housing together with the leadframe located therein, for example in a furnace. The heating of the stabilizing sections can also take place locally in each case on the stabilizing sections, for example by laser, infrared radiation, hot air, by contact with a heatable pressing tool, or the like.

If the heated stabilizing sections are molten, the leadframe is adhered to the tubular housing, wherein the material of the molten stabilizing sections is connected to the tubular housing by non-positive engagement. For example the leadframe can be pressed against the inner side of the tubular housing. Thus an adhesion of the leadframe to the tubular housing takes place by means of the stabilizing sections. Thus it is possible to save on a further adhesive or another type of fastening, so that the production process is simplified and costs can be saved.

The stabilizing sections for fastening the leadframe to the tubular housing can be applied to the surface of the leadframe which lies opposite the surface on which the semiconductor light elements are fastened. Thus the semiconductor light elements radiate the light which they generate first of all into the interior of the housing, so that a more uniform light emission from the tubular housing is achieved and the individual semiconductor light elements cannot be seen through the tubular housing.

In a further embodiment of the method the fastening of the leadframe in the tubular housing by means of the stabilizing sections takes place in that an adhesive which consists of a different material than the stabilizing sections is applied to at least some of the stabilizing sections. By means of this adhesive the stabilizing sections of the leadframe can then be adhered to the tubular housing.

In this embodiment the stabilizing sections replace other possible fastening elements such as for example retaining clips. Thus the stabilizing sections can perform two functions, namely the stabilisation of the leadframe as well as the bridging of the spacing between the leadframe and the tubular housing, so that less adhesive has to be used for the fastening of the leadframe.

The adhesive which is applied to the stabilizing sections can be a hotmelt adhesive, a two-component adhesive (such as for example epoxy resins), an adhesive which cures under UV radiation (such as for example Delo UV AD491 or UV AD494, which can be obtained from DELO Industrie Klebstoffe GmbH & Co. KGaA) or another adhesive which is suitable for effecting a sufficiently firm adhesive connection between the material of the stabilizing sections and the material of the tubular housing.

In one embodiment of the method the application of one or more stabilizing sections to the leadframe takes place in that a material jet for the stabilizing section is provided and the leadframe is moved by this material jet.

A material jet can be provided for example in that the material provided for the stabilizing sections is molten and is discharged through a nozzle (or another opening) in a reservoir. In particular the nozzle can be oriented so that the material discharged by the nozzle flows downwards (i.e. vertically) due to gravity, and in particular flows freely, i.e. does not run along on an underlying surface, comparable to the water discharged from a water tap. Such provision of a material jet can take place in particular with glass from a glass melt or with a hotmelt adhesive from a reservoir in which the molten adhesive is contained.

The horizontally oriented leadframe can be moved for example along its width through such a vertical material jet. Thus a stabilizing section can be produced by a continuous length of the material from the material for the stabilizing section on the leadframe. Next the leadframe can be offset for example in the longitudinal direction and again moved through the material jet in order to produce further stabilizing sections on the leadframe.

In this case, depending upon the viscosity of the material in the material jet, material can then also penetrate into the intermediate spaces between the leadframe elements.

The material jet can be continuously or discontinuously (in particular periodically), for example whenever the leadframe is moved through the material jet. Thus the material consumption can be reduced.

In a further embodiment of the method, the application of one or more stabilizing sections to the leadframe takes place through the positioning of a bar made from the material of the stabilizing section on the leadframe, which is then heated until the material of the bar becomes soft, in particular molten. The heated bar is then pressed onto the leadframe and forms a non-positively and/or positively engaged connection to the leadframe. In particular the material of the bar can also penetrate into the intermediate spaces between the leadframe elements. A bar made from the material of the stabilizing section can be made in particular from a hot melt adhesive. The above and following description of a bar made from the material of the stabilizing section likewise covers the use of a plurality of individual bar sections.

Such an application of a stabilizing section to the leadframe can take place both from one side (that is to say on a surface of the leadframe) and also simultaneously from both sides (that is to say on both surfaces of the leadframe), in particular at the same position, so that a stabilizing section is produced at the same location on both surfaces of the leadframe.

The heating and pressing of the bar can take place successively or also (at least partially) simultaneously, in particular by means of a heatable pressing tool.

Also if a stabilizing section is applied by means of a material jet (as described above), it can then be pressed on further and/or shaped by a pressing tool.

In one embodiment of the method at least one leadframe is provided in the form of a panel having a plurality of leadframes which are arranged alongside one another (that is to say parallel). In this case a panel is understood to be an arrangement of a plurality of leadframes which are not yet separated, and thus are in particular still connected to one another by means of connecting sections. The panel may consist only of an arrangement of a plurality of leadframes, but it can also have a peripheral frame or individual frame parts. The frame or the frame parts can also simplify the retention and/or the transport of the panel during the processing. The panel can be produced in particular from a metal sheet by stamping or cutting. Depending upon the width of the leadframe, measurements of the metal sheet and the machines used in the production of the leadframes, a panel can have a different number of leadframes. For example, approximately 14 to approximately 24, in particular 16 leadframes arranged adjacent to one another are provided.

In this embodiment the application of one or more stabilizing sections to the leadframe takes place in that at least one stabilizing section is applied as a continuous stabilizing section over at least two (in particular over all) leadframes of the panel arranged adjacent to one another. As a result, fewer individual processing steps are necessary.

In one embodiment of the method a stabilizing section having at least one predefined breaking point can be provided over a plurality of leadframes of a panel. In particular a predefined breaking point can be produced in each case between two adjacent leadframes. In this way the separation of the leadframes can be simplified. A predefined breaking point is understood in particular as a location on the stabilizing section on which the thickness of the stabilizing section (perpendicular to the surface of the leadframe) is decreased.

A predefined breaking point can be formed for example by a reshaping of a stabilizing section which is still soft, for example by means of a pressing punch. A predefined breaking point can also be formed simultaneously with the heating and pressing of a bar, for example by means of a correspondingly shaped pressing tool. Furthermore, a predefined breaking point can only be produced when the material of the stabilizing section has become hard (for example after the cooling), for example by cutting or milling the predefined breaking point in the stabilizing section.

The present invention further relates to a tube lamp comprising a tubular housing and a light engine arranged at least partially inside the tubular housing with a leadframe and one or more stabilizing sections mounted on the leadframe, wherein the leadframe is fastened in the tubular housing by means of the stabilizing sections. The details and explanations described above in connection with the method of production also apply to the tube lamp.

The stabilizing sections can be made, for example, from a thermoplastic material (in particular from a hotmelt adhesive) and/or from glass.

In one embodiment the leadframe is adhered to the tubular housing by means of the stabilizing sections. Thus in this embodiment the material of the stabilizing sections serves directly as an adhesive between the leadframe and the tubular housing. The adhesion can take place in particular by heating and/or remelting of the stabilizing sections.

In one embodiment at least some of the stabilizing sections of the leadframe are adhered in the tubular housing by means of an adhesive which is made from a different material than the stabilizing sections. Here the stabilizing sections additionally undertake in particular the function of retaining clips.

The aspects of the application of stabilizing sections to a leadframe which are explained above can also be applied regardless of the fastening of the leadframe by means of the stabilizing sections. In other words, a leadframe can be provided with stabilizing sections as described above, but can then be fastened however by means of other fastening means (such as for example retaining clips) in a housing of a lamp.

The aspects of the application of stabilizing sections to a leadframe which are explained above can also be applied regardless of the shape of the lamp. In other words, a leadframe for a lamp with a different housing (for example with a bulb in the shape of a conventional light bulb) can also be provided with stabilizing sections as described above.

Thus the present disclosure relates to a method for producing a leadframe with one or more stabilizing sections for a lamp, in particular for a tube lamp, comprising the steps of providing a material jet for a stabilizing section and moving the leadframe through the material jet.

The present disclosure also relates to a method for producing a leadframe with one or more stabilizing sections for a lamp, in particular for a tube lamp, comprising the steps of positioning a bar made from the material of a stabilizing section on the leadframe, heating the bar and pressing the bar on the leadframe.

Thus the present disclosure relates to a method for producing a leadframe with one or more stabilizing sections for a lamp, in particular for a tube lamp, comprising the steps of providing a panel having a plurality of leadframes which are arranged adjacent to one another, and applying at least one stabilizing section as a continuous stabilizing section over at least two leadframes arranged adjacent to one another. In one embodiment at least one stabilizing section can be provided with at least one predefined breaking point.

Further embodiments can comprise the above-mentioned aspects and features.

BRIEF DESCRIPTION OF THE DRAWINGS

Preferred further embodiments of the invention are explained in greater detail by the following description of the drawings. In the drawings.

DETAILED DESCRIPTION OF PREFERRED EXEMPLARY EMBODIMENTS

Figure 1:
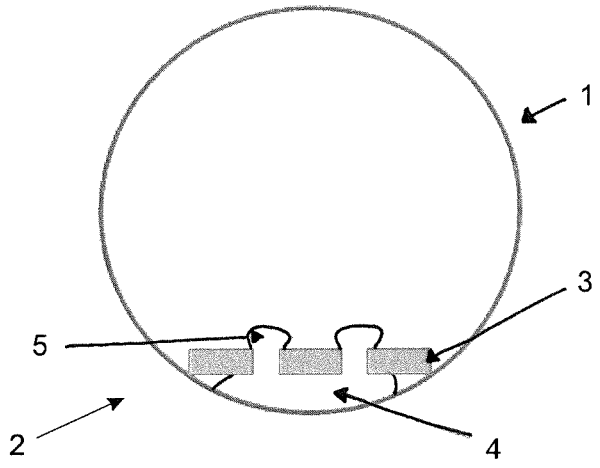
FIG. 1 shows an embodiment of a tube lamp according to the present invention.

Preferred exemplary embodiments are described below with reference to the drawings. In this case elements which are the same, similar, or act in the same way are provided with identical reference numerals in the different drawings, and repeated description of some of these elements is omitted in order to avoid redundancies.

Directional details such as "at the top", "at the bottom", "right" and "left" referred to below relate to the representation in den drawings.

FIG. 1 shows schematically an embodiment of an LED retrofit tube lamp according to the present invention in cross-section (perpendicular to the longitudinal direction). The tube lamp has a tubular housing 1. A leadframe 2 with a plurality of leadframe elements 3 is arranged in the interior of the housing 1. LEDs fastened to the upper surface of the leadframe 2 are not shown in this illustration.

A stabilizing section 4 extends on the lower surface of the leadframe 2 over the plurality of leadframe elements 3 and connects these mechanically to one another. The stabilizing section 4 consists of an electrically non-conductive material (for example made from a hot melt adhesive), so that no electrical connection is produced between the leadframe elements 3 by the stabilizing section 4.

The stabilizing section 4 has extensions 5, which extend through the intermediate spaces between the leadframe element 3 and are spread on the other side of the leadframe 2 and at least partially abut the upper surface of the leadframe 2. As a result a non-positively and a positively engaged connection take place between the leadframe 2 and the stabilizing section 4.

Furthermore, the stabilizing section 4 is in non-positively engaged, in particular adhesive connection to the inner side of the tubular housing 1. In other words, by means of the stabilizing section 4 the leadframe 2 is adhered to the tubular housing 1.

Figure 2:
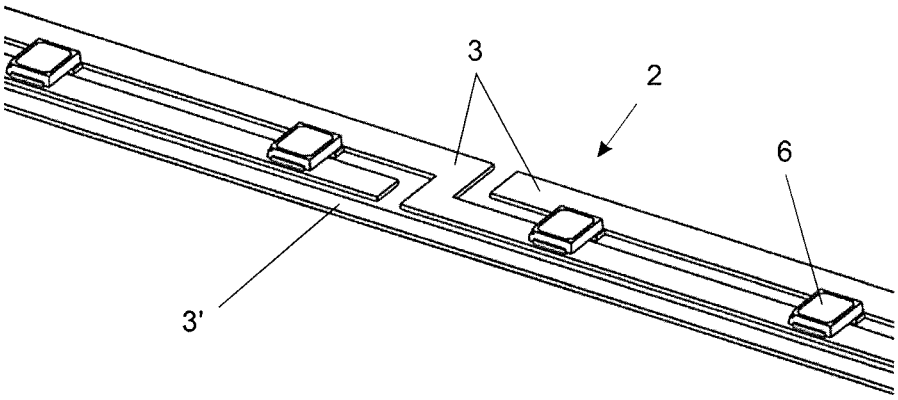
FIG. 2 shows a leadframe for a tube lamp without stabilizing sections.

FIG. 2 shows schematically a leadframe 2 for a tube lamp without stabilizing sections. The leadframe 2 has a plurality of leadframe elements 3, between which LEDs 6 are fastened (for example soldered). It can be clearly seen from this illustration that in a leadframe without stabilizing sections a high loading of the solder points and/or LEDs can occur. Also the lower continuous leadframe element 3' is not connected to the other leadframe elements 3 by means of a long region (in the extreme case over the entire length of the leadframe 2, which in so-called 5-foot lamps can amount to almost 150 cm).

Figure 3:
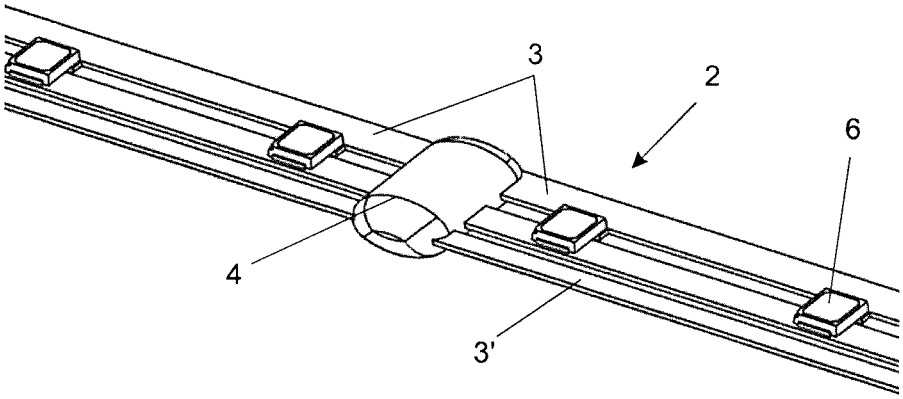
FIG. 3 shows the leadframe according to FIG. 2 with a two-sided stabilizing section.

In FIG. 3 the leadframe 2 according to FIG. 2 is shown schematically with a stabilizing section 4. The stabilizing section 4 connects a plurality of leadframe elements 3, 3' along both surfaces of the leadframe 2. The stabilizing section 4 consists of an electrically non-conductive material (for example made from a hot melt adhesive), so that no electrical connection is produced between the leadframe elements 3 by the stabilizing section 4.

The stabilizing section 4 can also extend through the intermediate spaces between the leadframe element 3, 3'. As a result a non-positively and a positively engaged connection take place between the leadframe 2 and the stabilizing section 4.

Figure 4:
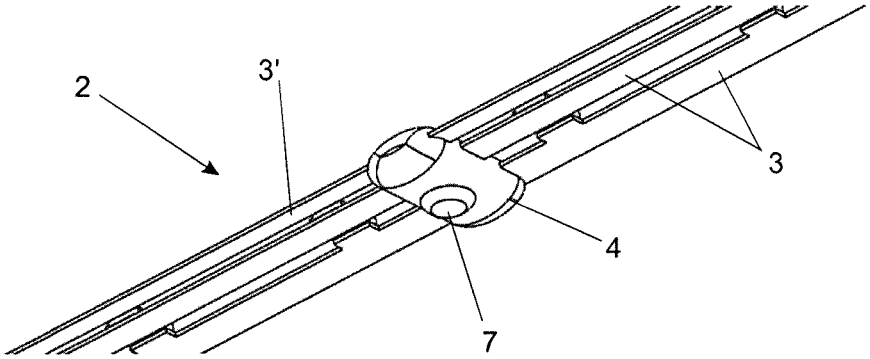
FIG. 4 shows the leadframe according to FIG. 3 from another view.

In FIG. 4 the leadframe 2 of FIG. 3 can be seen from another view (from below). Here it is shown schematically that an adhesive 7 (for example a hot melt adhesive, a two-component adhesive or an adhesive which cures under UV radiation) is applied to the underside of the stabilizing section 4, by which the stabilizing section 4 can be connected to a housing 1 of a tube lamp.

Figure 5:
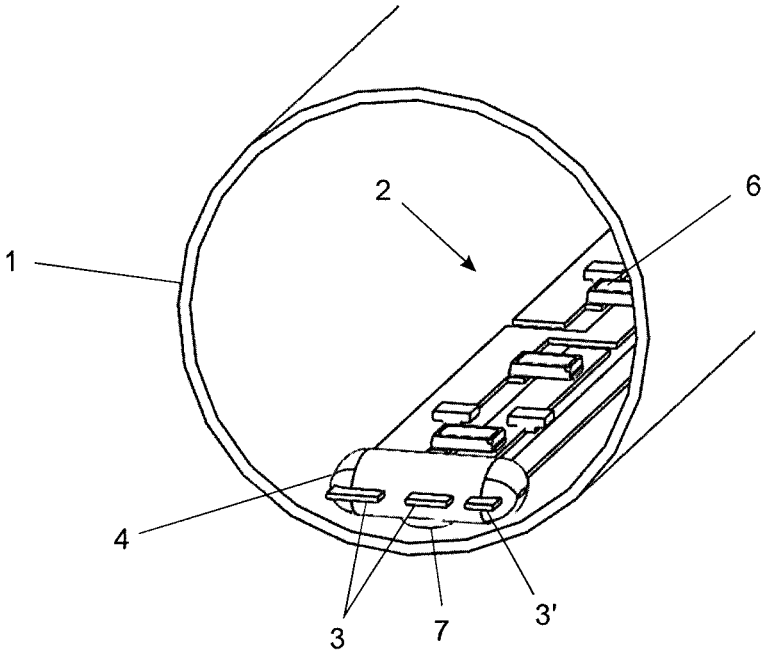
FIG. 5 shows an embodiment of a tube lamp according to the present invention.

The illustration according to FIG. 5 shows schematically an embodiment of a tube lamp according to the present invention. Here the leadframe 2 according to FIG. 3 and FIG. 4 is arranged in a tubular housing 1 of a tube lamp. The stabilizing sections 4 are connected by non-positive engagement by means of the adhesive 7 to the inner side of the tubular housing 1. The stabilizing section 4 bridges a large part of the distance between the leadframe 2 and the tubular housing 1. In this way only a small amount of the adhesive 7 is required, so that in particular the handling of the leadframe 2 is simplified when it is installed in the tubular housing 1.

Figure 6:
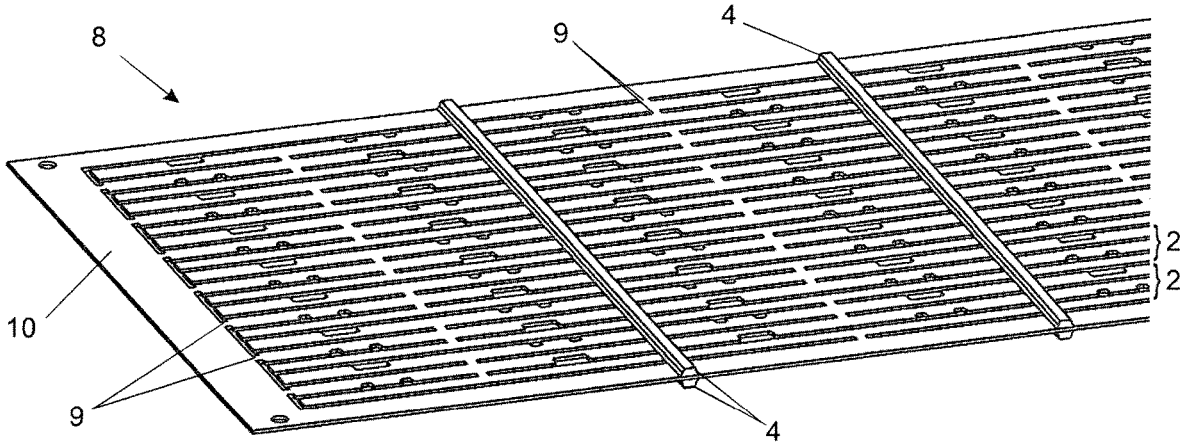
FIG. 6 shows a panel with a plurality of leadframes and stabilizing sections.

FIG. 6 shows schematically a panel 8 with a plurality of leadframes 2 and stabilizing sections 4. The panel 8 contains seven leadframes 2, which are still connected to one another by connecting sections 9. It may also be provided that a panel having a different number of leadframes can be used. The panel 8 further comprises a frame 10, which is likewise connected by means of connecting sections 9 to the leadframe 2. The panel 8 can be produced for example by stamping or cutting out from a metal sheet.

At a plurality of locations on the panel 8 stabilizing sections 4 extend opposite one another along both surfaces of the leadframe 2 over the entire width of the panel 8. In the illustration only two locations with stabilizing sections 4 are shown, but stabilizing sections 4 can be provided over the entire length of the panel 8 and thus of the leadframe 2.

The stabilizing sections 4 can also extend through the intermediate spaces between the leadframes 2. As a result a non-positively and a positively engaged connection are produced between each leadframe 2 and the stabilizing section 4.

Figure 7:
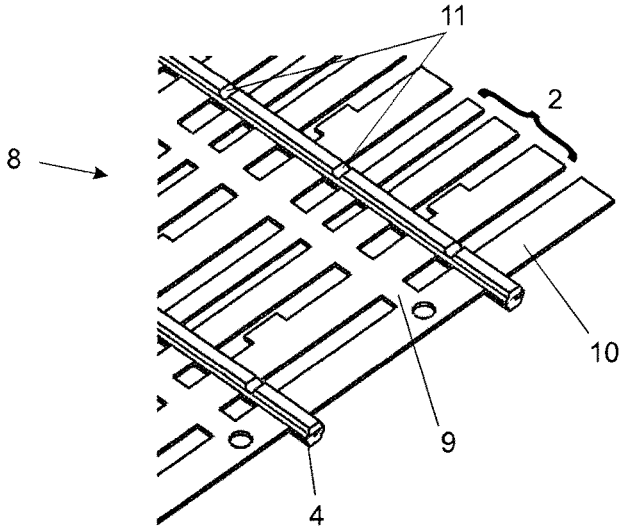
FIG. 7 shows a detail of a panel with a plurality of leadframes and with stabilizing sections with predefined breaking points.

FIG. 7 shows schematically a detail of a panel 8 with a plurality of leadframes 2. Here too, stabilizing sections 4 extend opposite one another along both surfaces of the leadframe 2 over the entire width of the panel 8. In each case between two leadframes 2 as well as between the outermost leadframe 2 and the frame 10 of the panel 8 the stabilizing sections 4 are provided with predefined breaking points 11 which are formed as U-shaped indentations. The predefined breaking points 11 enable the stabilizing sections 4 to part easily at the respective location in order to separate the leadframes 2.

Figure 8:
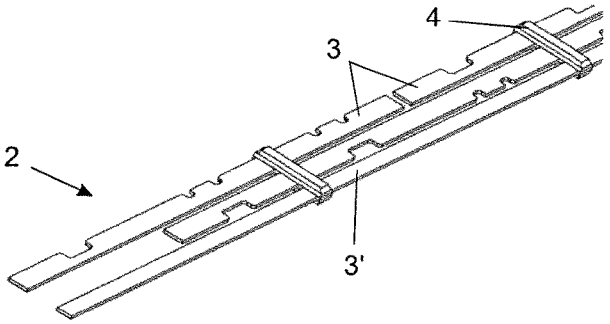
FIG. 8 shows an individual leadframe from the panel according to FIG. 7.

FIG. 8 shows schematically a detail of an individual leadframe from the panel according to FIG. 7. There are still no LEDs fastened on the leadframe 2, so that the leadframe elements 3, 3' are only held together by the stabilizing sections 4.

Alternatively LEDs can also be already mounted on the leadframe 2 before the separation of the leadframes 2 of a panel 8.

Although the invention has been illustrated and described in greater detail by the depicted exemplary embodiments, the invention is not restricted thereto and other variations can be deduced therefrom by the person skilled in the art without departing from the scope of protection of the invention.

In general "a" or "an" may be understood as a single number or a plurality, in particular in the context of "at least one" or "one or more" etc., provided that this is not explicitly precluded, for example by the expression "precisely one" etc.

Also, when a number is given this may encompass precisely the stated number and also a conventional tolerance range, provided that this is not explicitly ruled out.

If applicable, all individual features which are set out in the exemplary embodiments can be combined with one another and/or exchanged for one another, without departing from the scope of the invention.

LIST OF REFERENCES

1 tubular housing
2 leadframe
3, 3' leadframe elements
4 stabilizing section
5 extent of the stabilizing section
6' LED
7 adhesive
8 panel
9 connecting section
10 frame
11 predefined breaking point

The invention claimed is:

1. A method for producing a tube lamp, the method comprising:
- providing at least one leadframe, wherein the leadframe is substantially planar in form;
- applying one or more stabilizing sections to the leadframe; and
- fastening the leadframe in a tubular housing of the tube lamp using the stabilizing sections, wherein the one or more stabilizing sections are structurally distinct from the tubular housing.

2. The method according to claim 1, wherein the one or more stabilizing sections are made from at least one of a thermoplastic material and a glass.

3. The method according to claim 2, wherein fastening the leadframe in the tubular housing using the stabilizing sections comprises:
- heating the stabilizing sections to a temperature at which the stabilizing sections are molten; and
- adhering the leadframe to the tubular housing using the stabilizing sections.

4. The method according to claim 1, wherein fastening the leadframe in the tubular housing using the stabilizing sections comprises:
- applying an adhesive to at least several of the stabilizing sections; and
- adhering the stabilizing sections of the leadframe to the tubular housing with the adhesive.

5. The method according to claim 1, wherein applying one or more stabilizing sections to the leadframe comprises:
- providing a material jet for the stabilizing section; and
- moving the leadframe through the material jet.

6. The method according to claim 1, wherein applying one or more stabilizing sections to the leadframe comprises:
- positioning a bar or individual bar sections made from a material of the stabilizing section on the leadframe;
- heating the bar or the bar sections; and
- pressing the bar or the bar sections on the leadframe.

7. The method according to claim 1, wherein:
- providing at least one leadframe comprises providing a panel having a plurality of leadframes which are arranged adjacent to one another; and
- applying one or more stabilizing sections to the leadframe comprises applying at least one stabilizing section as a continuous stabilizing section over at least two leadframes arranged adjacent to one another.

8. The method according to claim 7, wherein applying at least one stabilizing section as a continuous stabilizing section over at least two leadframes arranged adjacent to one another comprises providing at least one continuous stabilizing section with at least one predefined breaking point.

9. A tube lamp comprising:
- a tubular housing;
- a light engine arranged at least partially inside the tubular housing, the light engine comprising a leadframe, wherein the leadframe is substantially planar in form; and
- one or more stabilizing sections mounted on the leadframe, wherein:
- the one or more stabilizing sections are structurally distinct from the tubular housing; and
- the leadframe is fastened in the tubular housing using the one or more stabilizing sections.

10. The tube lamp according to claim 9, wherein the one or more stabilizing sections are made from a thermoplastic material.

11. The tube lamp according to claim 9, wherein the leadframe is adhered to the tubular housing by the one or more stabilizing sections.

12. The tube lamp according to claim 9, wherein the leadframe is adhered to the tubular housing by an adhesive applied to the one or more stabilizing sections.

13. The tube lamp according to claim 9, wherein the one or more stabilizing sections are made from a glass.

14. The tube lamp according to claim 9, wherein the one or more stabilizing sections are made from an electrically insulating material.

15. The tube lamp according to claim 9, wherein the leadframe is configured as an electrically conductive structure that functions without an electrically insulating substrate or an electrically insulating flexible layer.

16. The tube lamp according to claim 9, wherein the leadframe is comprised of an electrically conductive metal.

17. The tube lamp according to claim 9, wherein the light engine further comprises at least one semiconductor light element arranged on and electrically connected to the leadframe.

18. The tube lamp according to claim 9, further comprising at least one electronic driver component arranged on and electrically connected to the leadframe.

19. The tube lamp according to claim 9, wherein the one or more stabilizing sections extend over a width of the leadframe, substantially perpendicular to a longitudinal length of the leadframe.

20. The tube lamp according to claim 9, wherein the one or more stabilizing sections are configured to both:

stabilize the leadframe inside the tubular housing; and bridge spacing between the leadframe and the tubular housing.

21. The tube lamp according to claim 9, wherein the one or more stabilizing sections are mounted on at least two opposing sides of the leadframe.

22. The tube lamp according to claim 9, wherein the one or more stabilizing sections extend through an interior space of the leadframe, contacting at least two opposing sides of the leadframe.

* * * * *